United States Patent [19]

Sacks et al.

[11] 4,386,940

[45] Jun. 7, 1983

[54] GASIFICATION OF CARBONACEOUS SOLIDS

[75] Inventors: Martin E. Sacks, East Windsor, N.J.; Richard H. McClelland, Pittsburgh, Pa.

[73] Assignee: Cogas Development Company, Princeton, N.J.

[21] Appl. No.: 309,637

[22] Filed: Oct. 8, 1981

[51] Int. Cl.[3] ..... C10J 3/54

[52] U.S. Cl. ..... 48/197 R; 48/202; 252/373

[58] Field of Search ..... 48/202, 206, 197 R; 252/373

[56] References Cited

U.S. PATENT DOCUMENTS

| | | | |
|---|---|---|---|
| 3,440,177 | 4/1969 | Patton et al. | 252/373 |
| 3,884,649 | 5/1975 | Matthews | 48/202 |
| 3,993,583 | 11/1976 | Seglin | 48/202 |

FOREIGN PATENT DOCUMENTS

| | | | |
|---|---|---|---|
| 2515858 | 10/1975 | Fed. Rep. of Germany | 48/202 |
| 1312860 | 4/1973 | United Kingdom . | |

*Primary Examiner*—Peter F. Kratz

*Attorney, Agent, or Firm*—Robert D. Jackson; Eugene G. Seems; Pauline Newman

[57] ABSTRACT

In a system of fluidized gasification of carbonaceous solids in which fines are burned in an external combustor to heat recycle solids, fines entrainment is reduced by introducing the finest of the fines into the combustor from the lower end of a fluidized fines feeder vessel whereby the said finest fines are selectively burned.

3 Claims, 1 Drawing Figure

*PREFERRED EMBODIMENT OF FINES FEEDER*

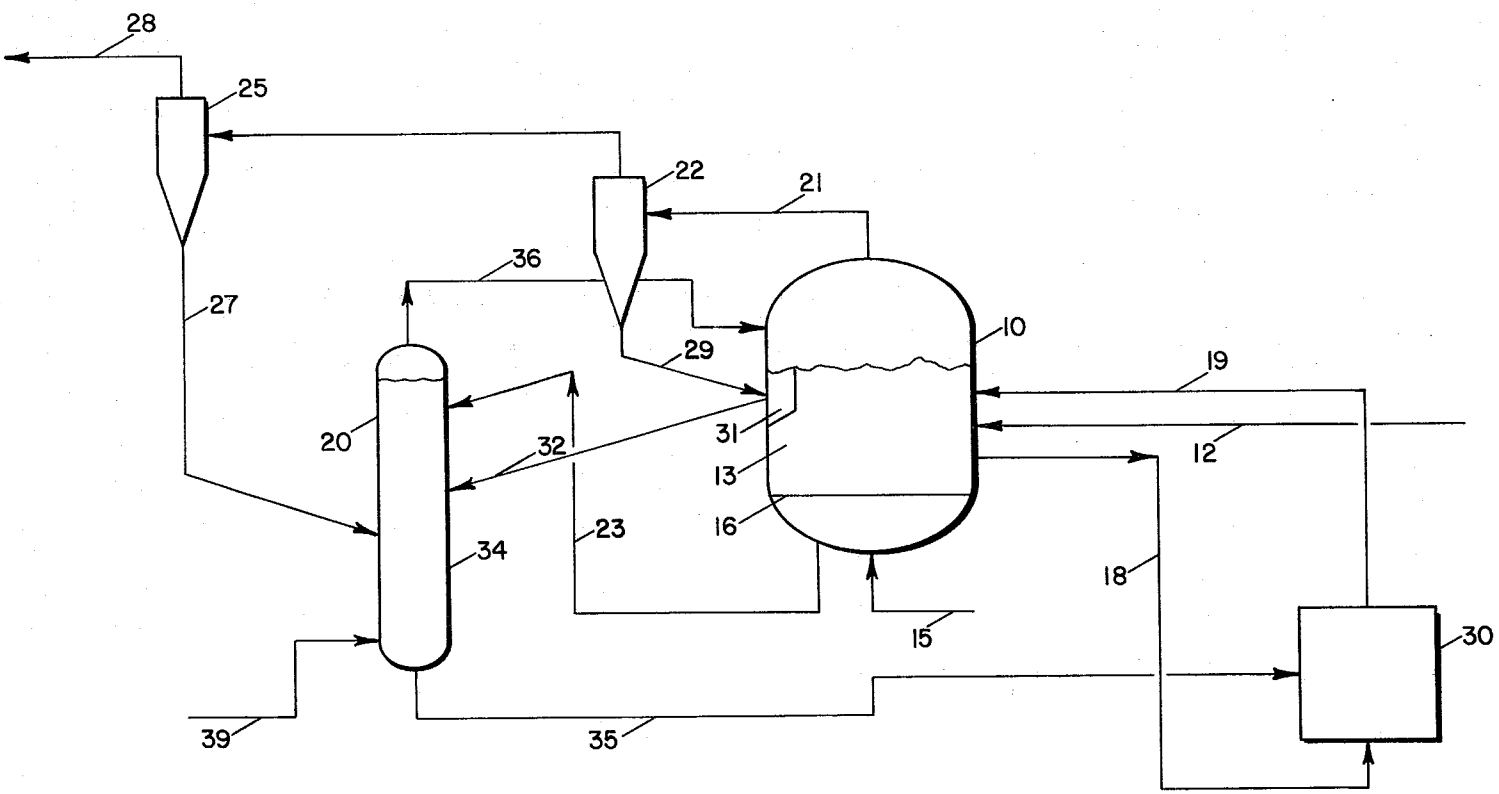
Fig. 1. PREFERRED EMBODIMENT OF FINES FEEDER

GASIFICATION OF CARBONACEOUS SOLIDS

This invention relates to the fluidized gasification of carbonaceous solids with steam to produce gases containing hydrogen and carbon monoxide, particularly to improvements in controlling fines entrainment.

The gasification of carbonaceous solids with steam in a fluidized bed to produce a gaseous mixture containing hydrogen and carbon monoxide is well-known. An especially important and extensive application of the technique is in coal gasification to produce substitute natural gas (SNG) by subjecting the hydrogen/carbon monoxide mixture to shift and methanation.

As is well-known, the gasification of carbon with steam is exceedingly endothermic, requiring essentially constant heat input to sustain the reaction. Where the gasification is conducted in a fluidized bed, reaction heat can be supplied by burning a portion of the carbon solids with oxygen introduced as a component of the fluidizing medium. However, this requires an oxygen plant which adds considerably to the cost of commercial gasification; air can be used but the product gas suffers from reduced caloric value because of nitrogen dilution. These problems can be circumvented by withdrawing some of the unreacted solids from the fluidized bed and burning them in an external combustion zone such as described in U.S. Pat. No. 3,440,177 to Patton et al. In this scheme, the withdrawn solids are divided into two portions, a first portion of which is burned to provide hot combustion gases, a second portion of which is heated by contact with the combustion gases and the resulting hot solids continuously conveyed to the fluidized gasification zone to supply gasification heat. Ash removed from the system in the combustion zone—desirably a slagging furnace—assures optimum carbon conversion rates by controlling ash buildup in the gasification zone.

In addition to the problem of providing heat to a gasification zone of fluidized carbonaceous solids, there is the further problem of controlling the fines, particularly where gasification heat is supplied by hot recycle solids as desscribed in the aforesaid Patton et al patent. The conventional approach in controlling such fines is to separate them from the product gas in a cyclone and return them to the gasifier for further gasification. However, a considerable fraction of the fines, because of their small average particle size, are entrained from the gasifier before they can react to an appreciable extent with the fluidizing atmosphere. Entrainment of fines can be mitigated somewhat by employment of multiple cyclones and/or reducing overall throughput, but these measures are generally impractical in terms of the results attained.

An improved method of handling gasifier fines is to utilize them as a source of heat for the gasification. In this procedure, which is disclosed in U.K. Pat. No. 1,312,860, the fines are separated from the synthesis gas and fed to a standard slagging combustor, where they are burned with air to form hot combustion gases. Recycle solids are dispersed in the hot gases for conveying heat to the gasification zone as above described.

Although a step forward, the process of the U.K. patent is not entirely satisfactory since there may be more fines present than can be consumed as fuel. The reason for this is not that the quantity of fines necessarily exceeds the fuel demands but rather because the use of carbon-rich fines as the sole or principal source of fuel does not provide for adequate ash rejection from the system. As a consequence, when carrying out the gasification process of the U.K. patent, it is still necessary to withdraw a certain amount of partially gasified bed solids to burn with the fines in order to obtain an ash-rich fuel mix for maintaining ash balance in the gasifier.

Surplus fines thus continue to accumulate, passing through the solids recovery cyclones, necessitating installation of scrubbers or other cleanup devices to remove the char dust from the product and flue gases. This not only adds to capital investment costs but constitutes a process deficiency in the form of carbon losses, since the char dust is carbon-rich. Ideally, all of the carbon in the char should be converted to product gas except that portion consumed as fuel.

The difficulties in the processes aforesaid can be overcome in accordance with the present invention by utilizing those fines having the smallest average particle size as fuel for the combustion zone in which the recycle solids are heated. This can be implemented by installation of a fluidized fines feeder vessel interposed between the source of fines and the combustion zone. In operation, the coarser or primary fines are introduced into the upper portion of the fines feeder vessel whereas the finer fuel fines fraction or secondary fines are injected into the lower portion thereof at which point it meets and is carried along by the downwardly flowing coarser fines. This combined fines stream is charged into the combustion zone where essentially all of the finest or secondary fines and some of the coarser primary fines are consumed as fuel. By this arrangement, dust losses from fines entrainment are substantially eliminated. The coarser primary fines in the upper portion of the fines feeder can be reintroduced into the gasification zone for additional gasification.

Although the process of the invention eliminates the finest or secondary fines by selectively burning them in the combustion zone, fines generally cannot serve as the sole fuel source because of ash buildup in the gasifier. As previously pointed out, fines are carbon-rich and thus their removal for use as fuel does not allow for sufficient ash rejection. Accordingly, in practicing the invention, a stream of partially reacted gasifier bed solids is fed into the fines feeder from whence they are conveyed to the gasification zone for maintaining ash balance. However, as above noted, the finest of the char particles, those that are normally expelled as dust in the prior art fluidized gasification systems, are used up as fuel. The process of the invention thus provides a means of controlling fines entrainment, maintaining ash balance and optimizing carbon utilization.

Reference is now made to the accompanying single FIGURE drawing depicting, in diagrammatical form, a fluidized gasification system utilizing the process of the invention.

Referring to the drawing, the gasification system shown therein essentially comprises a fluidized gasifier 10, a fluidized fines feeder vessel 20 and a furnace 30 whose functions and operation are explained in the ensuing discussion.

In operation, finely divided carbonaceous solids, such as a char obtained by the carbonization of bituminous coal in a fluidized bed (not shown) at temperatures not substantially exceeding 1000° F., is introduced at a rate of 110,625 pounds/hour into fluidized gasifier 10 by way of line 12. The particle size of the char generally falls within the following size distribution:

36.7% greater than 500 microns
85.3% greater than 50 microns
99.7% greater than 10 microns Line 12 may be part of any conventional means for conveying finely divided solids such as an aerated standpipe, a pressurized feed hopper, a mechanical conveyor, et cetera. The char particles in gasifier 10 form a dense turbulent mass 13 of solids fluidized with steam supplied through line 15 and grid 16. Linear gas velocities for the fluidizing steam of about 0.1–10 feet/second, preferably 0.3–3 feet/second, within mass 13 are generally suitable for this purpose at pressures ranging from about atmospheric to about 400 pounds/square inch and for bed densities of about 10–50 pounds/cubic foot.

Temperatures within fluidized mass 13 are maintained sufficiently high to induce gasification of the char with steam to produce a gaseous stream containing hydrogen and carbon monoxide. Gasification temperatures can range from about 1400°–2000° F., preferably about 1500°–1800° F.

Heat for sustaining the endothermic gasification reaction is provided by hot recycle char obtained by withdrawing a portion of char solids from gasifier 10 through line 18 and heating the stream by contact with hot combustion gases generated in heater 30, which is preferably a slagging furnace of standard manufacture. Furnace 30 is provided with air intake and liquid ash removal (not shown). The hot recycle char, typically at temperatures of 1500° F.–2100° F., preferably 1600° F.–1900° F., is returned to gasifier 10 by way of line 19. Approximately 50 parts of recycle char to one part of char feed is used. Fines, which are collected in fines feeder vessel 20 in a manner to be explained in detail hereinafter, are sent to furnace 30 and burned therein with air to generate the hot combustion gases for heating the recycle char. The temperature of the furnace is maintained sufficiently high, typically 3500° F. to form liquid ash which is tapped in the known manner of operating slagging furnaces.

Product gases are withdrawn overhead from the top of mass 13 through line 21 and passed sequentially through primary cyclone 22 and secondary cyclone 25 provided with solids return lines 29 and 27, respectively. Gases substantially free of solids leave through exit line 28 and flow to further processing equipment and/or any desired use such as a hydrocarbon synthesis reactor or the like (not shown) if desired, after heat exchange with solid and/or gaseous feed materials of the herein process.

The char elutriated from the gasifier 10 through line 21 amounts to 256,346 pounds/hour of which 255,722 pounds/hour are collected by the primary cyclone 22. Preferably, the primary fines are charged into a low velocity stilling well 31 located within gasifier 10.

Primary fines from stilling well 31 are conducted via line 32 into the upper part of fluidized fines feeder vessel 20 at a rate of 29,110 pounds/hour; 88.6% of the primary cyclone 22 underflow, overflows the stilling well and is returned to the gasifier. Steam at a flow rate of 600–1000 pounds/hour is introduced through line 39 into the bottom of vessel 20 at sufficient velocity to permit a countercurrent downward flow of fluidized primary fines with the upwardly flowing steam. A fluidized bed 34 of primary fines is thus produced and maintained at a height, so as to exert a hydrostatic head exceeding the pressure in the furnace 30 and thus assure the flow of char solids from vessel 20 by way of line 35 to said furnace 30. Gaseous overheads and suspended char particles are vented from the top of vessel 20 and returned to the gasifier 10 through line 36.

Fines from the underflow of the secondary cyclone 25 are conveyed at a rate of 565 pounds/hour through line 27 and introduced into the lower part of fines feeder vessel 20. The particle size distribution of the secondary fines is typically about 66% of 10 to 50 microns and 44% minus 10 microns. On entering vessel 20, the secondary fines are carried downwardly by the descending current of primary fines and are thereby transported to combustor 30. Partially reacted char particles are withdrawn from gasifier 10 and injected via line 23 into the vessel 20 at a rate sufficient to control the ash content of gasifier 10 in order to maintain the gasification reaction. A withdrawal rate of gasifier char of 18,551 pounds/-hour serves to maintain an ash content of 52% in gasifier 10.

The total fuel char solids flowing downwardly through feeder vessel 20 thus amounts to 48,226 pounds/hour of which 18,551 pounds/hour are gasifier char; 29,110 pounds/hour primary fines and 565 pounds/hour secondary fines. These solids flow down feed vessel 20 at a rate less than 10 pounds/second (feet$^2$), preferably less than 3 pounds/second (feet$^2$); fluidizing steam flows up feed vessel 20 at a rate of less than 1 foot/second, preferably less than 0.5 feet/second. In the drawing, the fines are depicted as coming from the cyclones in the product gas; alternately the fines can be collected from the flue gas used in heating the recycle solids; also a combination of product and flue gas fines can be routed to the vessel 20.

If the collection rate of fines exceeds the fuel requirements of furnace 30, excess fines overflow from the fines feeder (line not shown) and are returned to the gasifier 10 where they are gasified. In the event that the fines collection rate is less than the fuel requirements of the process, or if the ash content of the fines is not sufficient to reject the ash in the feed char to the gasifier 10 as slag in slagging combustor, make-up fuel can be taken from the gasifier 10 or from some other point in the process and fed to the fines feeder 20. Hot fuel fines exit from the bottom of the fines feeder 20.

The technique for controlling solids injection into a slagging combustor is well-known in the furnace and fuel arts.

The foregoing description and exemplary operations have served to illustrate specific applications and results of the invention. However, other modifications obvious to those skilled in the art are within the scope of the invention. Only such limitations should be imposed on the invention as are indicated in the appended claims.

What is claimed is:

1. In a gasification system of converting ash containing carbonaceous solids into a gaseous mixture containing hydrogen and carbon monoxide by the endothermic reaction of said solids with steam in a fluidized gasification zone wherein heat for the endothermic reaction is supplied by continuously circulating a recycle stream of said solids between the gasification zone and a combustion zone in which the said recycle stream is heated by contact with hot combustion gases formed by burning at least a portion of carbonaceous fines elutriated from said gasification system, the improvement of reducing dust losses from the gasification system while maintaining ash balance in the gasification zone for optimum conversion comprising (A) introducing the elutriated fines into the combustion zone from the bottom of a fluidized fines feeder vessel, the finest fines in said elutriated fines being introduced at the lower end of the fines feeder vessel and the coarser fines in said elutriated fines being introduced into the fines feeder vessel at a point above where the finest fines are introduced, the finest fines being carried by the downwardly flowing coarser fines thereby ensuring that the finest fines are preferentially burned in the combustion zone and (B) introducing sufficient carbonaceous solids from the gasification zone into the fines feeder vessel at a point above the entry of the finest fines in order to control the ash content of the carbonaceous solids in the gasification zone for maintaining the gasification reaction.

2. The improvement of claim 2 wherein the carbonaceous solids are produced by the fluidized pyrolysis of bituminous coal at about 1000° F.

3. The improvement of claim 2 wherein the downward flow of solids in the fluidized fines feeder vessel is less than 10 pounds/second (feet$^2$) and the velocity of the fluidizing gas in said vessel is less than 1 foot/-second.

* * * * *